US009835148B2

(12) United States Patent
Tincher et al.

(10) Patent No.: US 9,835,148 B2
(45) Date of Patent: Dec. 5, 2017

(54) INTELLIGENT NETWORK FOR CHEMICAL DISPENSING SYSTEM

(71) Applicant: Delaware Capital Formation, Inc., Wilmington, DE (US)

(72) Inventors: Terry Tincher, Lebanon, OH (US); Sean Lafferty, Taylor Mill, KY (US); Jason McDaniel, Independence, KY (US); Bryan Andersen, Cincinnati, OH (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 15/232,386

(22) Filed: Aug. 9, 2016

(65) Prior Publication Data

US 2016/0348668 A1 Dec. 1, 2016

Related U.S. Application Data

(62) Division of application No. 13/273,581, filed on Oct. 14, 2011, now Pat. No. 9,447,536.

(51) Int. Cl.
*G05D 7/00* (2006.01)
*G05D 11/00* (2006.01)
(Continued)

(52) U.S. Cl.
CPC ..... *F04B 49/065* (2013.01); *A47L 15/4293* (2013.01); *A47L 15/4418* (2013.01);
(Continued)

(58) Field of Classification Search
CPC .... F04B 49/065; F04B 43/1292; F04B 13/00; F04B 13/02; A47L 15/4293;
(Continued)

(56) References Cited

U.S. PATENT DOCUMENTS 4,903,862 A * 2/1990 Shannon ..... B67D 1/0009 222/108
5,014,211 A * 5/1991 Turner ..... B01F 15/0416 137/266
(Continued)

FOREIGN PATENT DOCUMENTS

EP 0403296 A1 12/1990
WO 2006000237 A1 1/2006

OTHER PUBLICATIONS

European Patent Office, extended European search report issued in Application No. 12188406.8 dated Sep. 30, 2015.
(Continued)

*Primary Examiner* — Patrick M Buechner
*Assistant Examiner* — Benjamin R Shaw
(74) *Attorney, Agent, or Firm* — Wood Herron & Evans LLP

(57) ABSTRACT

System and method for dispensing product to a washing machine. A chemical dispensing system includes a system controller, machine interface, and pump controller that communicate through serial data buses. The system controller provides a user interface, retrieves washing machine status information from the machine interface, and issues product dispensing commands to the pump controller. The pump controller monitors pump status and dispenses product in response to commands from the system controller. The pump controller: (1) determines pump activation periods based on calibration data stored in a pump controller memory; (2) tracks pump usage and adjusts the activation period to compensate for pump wear as the pump ages; (3) disables the pump if conditions exists that preclude operating the pump; (4) monitors product levels, and (5) reports pump status to the system controller. Integral channels are
(Continued)

included in the pump housing to provide stress relief to a squeeze tube.

11 Claims, 9 Drawing Sheets

(51) Int. Cl.

| | |
|---|---|
| ***F04B 49/06*** | (2006.01) |
| ***A47L 15/44*** | (2006.01) |
| ***D06F 39/02*** | (2006.01) |
| ***D06F 33/02*** | (2006.01) |
| ***A47L 15/42*** | (2006.01) |
| ***D06F 39/00*** | (2006.01) |
| ***F04B 43/12*** | (2006.01) |

(52) U.S. Cl.
CPC ..... *D06F 33/02* (2013.01); *D06F 39/005* (2013.01); *D06F 39/02* (2013.01); *D06F 39/022* (2013.01); *F04B 43/1292* (2013.01); *A47L 15/449* (2013.01); *A47L 15/4463* (2013.01); *A47L 2401/023* (2013.01); *A47L 2501/07* (2013.01); *D06F 2204/02* (2013.01)

(58) Field of Classification Search
CPC ..... A47L 15/4463; A47L 2401/023; A47L 2501/07; D06F 33/02; D06F 39/005; D06F 39/02; D06F 39/022; D06F 2204/02
USPC ..... 222/1, 214; 417/477.1–477.3; 700/282, 700/283, 281
See application file for complete search history.

(56) References Cited

U.S. PATENT DOCUMENTS

| | | | | |
|---|---|---|---|---|
| 5,390,385 | A | 2/1995 | Beldham | |
| 5,392,618 | A * | 2/1995 | Livingston | B01F 15/0454 137/266 |
| 5,449,017 | A | 9/1995 | Collins et al. | |
| 5,509,788 | A * | 4/1996 | Livingston | D06F 39/022 222/651 |
| 5,897,671 | A * | 4/1999 | Newman | D06F 39/022 222/1 |
| 6,354,345 | B1 * | 3/2002 | Nabity | E21B 43/121 141/130 |
| 6,393,338 | B1 * | 5/2002 | Kemnitz | F04B 43/0081 417/22 |
| 6,434,772 | B1 * | 8/2002 | Barbe | D06F 39/022 68/12.18 |
| 2004/0265154 | A1 | 12/2004 | McDowell et al. | |
| 2005/0123408 | A1 * | 6/2005 | Koehl | F04D 15/0088 417/53 |
| 2005/0209563 | A1 * | 9/2005 | Hopping | A61M 1/28 604/151 |
| 2005/0238516 | A1 * | 10/2005 | Kent | F04B 43/1292 417/477.8 |
| 2007/0261177 | A1 | 11/2007 | Risen et al. | |
| 2008/0038129 | A1 * | 2/2008 | Higuchi | B01L 3/021 417/477.2 |
| 2008/0169309 | A1 | 7/2008 | Kroeger | |
| 2014/0188516 | A1 * | 7/2014 | Kamen | G06F 19/3406 705/3 |

OTHER PUBLICATIONS

European Patent Office, Official Letter issued in counterpart Application No. EP12188406.8 dated Oct. 26, 2016, 4 pp.

* cited by examiner

INTELLIGENT NETWORK FOR CHEMICAL DISPENSING SYSTEM

FIELD OF THE INVENTION

The invention relates generally to chemical dispensing systems for laundry, ware-wash, and healthcare, and more particularly to systems and methods for automatic control of product dispensing in a chemical dispensing system.

BACKGROUND OF THE INVENTION

The dispensing of liquid chemical products from one or more chemical receptacles is a common requirement of many industries, such as the laundry, textile, ware wash, healthcare instruments, and food processing industries. For example, in an industrial laundry facility, one of several operating washing machines will require, from time to time, aqueous solutions containing quantities of alkaloid, detergent, bleach, starch, softener and/or sour. Increasingly, such industries have turned to automated methods and systems for dispensing chemical products. Such automated methods and systems provide increased control of product use and reduce human contact with potentially hazardous chemicals.

Contemporary automatic chemical dispensing systems used in the commercial washing industry typically rely on pumps to deliver liquid chemical products from bulk storage containers. Generally, these pumps deliver raw product to a washing machine via a flush manifold, where the product is mixed with a diluent, such as water, that delivers the chemical product to the machine. A typical chemical dispensing system used to supply a washing machine will include a controller that is coupled to one or more peristaltic pumps in a pump-stand by a plurality of dedicated signal lines. The controller will also typically be coupled to a washing machine interface by another plurality of dedicated signal lines, so that the controller is provided with signals indicating the operational state of the machine. In operation, the machine interface transforms high voltage trigger signals generated by the washing machine into lower voltage signals suitable for the controller, and transmits these low voltage trigger signals to the controller over the set of dedicated signal lines, which are typically in the form of a multi-conductor cable. In response to these individual trigger signals, the controller will individually activate one or more of the pump-stands over another set of dedicated lines so that the pumps dispense a desired amount of a chemical product into the flush line. The chemicals are then are mixed with a dilutant before being delivered to the machine.

In the chemical dispensing system described above, the controller is connected to each washing machine trigger signal output and pump by a dedicated line, and the controller directly activates and deactivates each of the pumps. This arrangement, while generally satisfactory for its intended purpose, places practical limits on how many trigger signals and pumps can be connected to a single controller and creates a need for large numbers of wires and controller input ports. Installation of these types of systems can be cumbersome since installers must keep track of each signal line and ensure that the each line couples the proper controller port to the proper trigger signal source or pump. An incorrect connection may result in the wrong chemical being dispensed at the wrong time by the system, and may not be immediately apparent, resulting in many incorrectly processed loads and resulting monetary losses. Moreover, because the controller is merely switching the pumps on and off for an amount of time expected to provide a desired amount of chemical to the flush manifold, the controller receives no feedback regarding whether the pump is actually dispensing the amount of product desired.

Chemical dispensing systems employed with commercial washing machines typically employ peristaltic pumps to minimize both operator and system component contact with the chemical products, which are often corrosive and toxic. Peristaltic pumps of this type include a flexible tube (or squeeze tube) and a rotor with one or more rollers located in a pump chamber. The one or more rollers compress a section of the squeeze tube against a wall of a pump chamber, pinching off the section of squeeze tube. When the rotor is rotated, the location of the pinched section of the squeeze tube moves along the length of the tube, thereby forcing, or pumping, fluid through the tube. The amount of fluid pumped per unit time tends to vary from pump to pump, depending on multiple variables such as the speed with which the rotor turns, the interior diameter of the squeeze tube, and the viscosity of the product being dispensed. Therefore, system installers must perform calibration measurements on each pump so that the system controller dispenses accurate amounts of product. This requirement for calibrating each pump during installation greatly increases installation time and expense.

Squeeze tubes are also subject to wear over time from the repeated compression and pulling of the rollers, which causes the volume of chemical pumped by the pump-stand to vary over time. Worn out squeeze tubes must also be periodically replaced to prevent tube failure. Squeeze tube replacement can be a cumbersome endeavor, as chemical product often leaks from the feed lines when the seal is broken between the squeeze tube and feeder tubes. In addition to causing a loss of product and undesirably exposing workers to potentially hazardous chemicals, the spilled product may also contaminate the surfaces of the squeeze tube and pump chamber. If the chemical product is not sufficiently cleaned from these surfaces, the resulting sticky residue can cause the roller to pull the squeeze tube through the pump chamber so that the tube becomes damaged or tangled, resulting in pump failure and further potential product spills. In addition, because the controller cannot determine that the pump is not dispensing the correct amount of product, any processed wash loads that rely on the failed pump will have to be re-processed. Further, because the timing of the pump failure may be difficult to determine, multiple wash loads may have to be reprocessed.

Therefore, there is a need in the art for improved chemical dispensing system components and methods that more accurately and reliably control the dispensing of chemical products into washing machines, and that reduce the maintenance burden and number of potential failure modes associated with peristaltic pumps.

SUMMARY OF THE INVENTION

In a first aspect of the invention, a chemical dispensing system controller includes a plurality of serial data bus interfaces that allow the system controller to communicate with other chemical dispensing system components over one or more intelligent networks. To this end, the system controller may include serial data bus interfaces that provide communications between the system controller and a plurality of pump controllers, machine interfaces, network gateways, as well as other system controllers. The system controller may also include additional serial bus interfaces to accommodate future system expansion. By communicating over serial data buses instead of using dedicated signaling lines, the system controller may reduce the number of physical connections required between the dispensing system components, thereby increasing system reliability and reducing installation time. The flexibility provided by digital communications over the serial data buses also provides additional advantages to the chemical dispensing system, such as providing support for more intelligent system components as well as future system improvements, the addition of new features, and system expansion.

To support networking functions between the system controller and the pump-stand, each pump includes a pump controller with a user selectable serial data bus address. The system controller controls the timing and amounts of chemicals dispensed to the washing machine by communicating with individual pump controllers connected to the pump controller serial data bus interface using the user selectable addresses. The pump controller provides several advantages to the chemical dispensing control system in addition to supporting the system controller networking function, such as improved dispensing accuracy and pump status monitoring.

In a second aspect of the invention, the pump controller may be loaded with pump calibration data at the factory. The pump calibration data is accessible to the pump and system controllers and is used to calculate pump run times and/or the number of pump rotor rotations necessary to deliver a desired amount of chemical product. Advantageously, by loading pump calibration data into the pump controller at the factory, the need to perform pump-stand calibrations during installation is reduced or eliminated, thereby reducing installation time and expense.

In a third aspect of the invention, the chemical dispensing system tracks the operational time and/or number of operational cycles on each of the squeeze tubes installed in the pumps. Using test data regarding the expected service life of the squeeze tube, the chemical dispensing system estimates the remaining service life of the tube from aging and wear based on the operational conditions (e.g., age, type of chemicals pumped, amount of chemicals pumped, etc.) experienced by the squeeze tube. The chemical dispensing system may then report out the estimated remaining tube life, as well as provide an indication to system operators when a squeeze tube should be replaced because the squeeze tube is nearing the end of its useful service life. Tracking estimated remaining service life may also provide additional operational benefits and advantages to the dispensing system.

For example, to improve produce dispensing accuracy, the chemical dispensing system may adjust pump activation periods for a specific output based on expected changes in pump capacity due to estimated wear and aging of the squeeze tube. To this end, the pump controller may increase the amount of time the pump is activated for a given amount of product to be dispensed as the squeeze tube ages to compensate for an expected reduction in pump capacity. The pump controller may thereby improve pump dispensing accuracy over the life of the squeeze tube. When the squeeze tube is replaced, the time and usage tracking in the pump controller may be reset by a system operator through a user interface on the system controller. The system controller may also provide an interface that allows the system operator to update the pump calibration data based on a new pump calibration.

In a fourth aspect of the invention, the system controller controls the amount and type of chemical product dispensed by sending data addressed to the pump controller for the pump from which a desired amount of chemical is to be dispensed. The data includes data indicative of the amount of chemical product to be dispensed, which the pump controller uses to determine the amount of time and/or number of rotor rotations for which to activate the pump. The pump controller may also use stored calibration data and/or wear data for the squeeze tube to adjust the pump activation period. In an alternative embodiment, the system controller may retrieve the calibration data from the pump controller and use the calibration data to determine an activation period for the pump. In either case, once the required activation period is determined and communicated to the pump controller, the pump controller activates the pump for the determined period, thereby supplying the desired amount of chemical product to the washing machine.

Advantageously, by communicating the amount of product to be dispensed to the pump controller rather than directly activating and deactivating the pump, the pump may more accurately dispense the desired amount of chemical product. More advantageously, because the pump controller controls activation of the pump locally, if communication is lost between the system controller and pump controller after activation of the pump (for example, due to a loose or intermittent connection), the pump controller can still dispense the desired amount of product. This is in contrast to a pump activated directly by a system controller, which might stop dispensing chemical product prematurely upon loss of communications with the system controller, or worse yet, might continue running indefinitely if communications are lost between the time the pump is activated and the time the deactivation signal is sent.

To further improve the accuracy of the amount of product dispensed, the pump controller may be coupled to one or more temperature sensors that provide signals indicating the temperature of the chemical product that the pump is dispensing. Advantageously, this may improve the accuracy of the chemical dispensing over a range of temperatures. For example, if a container of chemical product that was recently delivered (or that is stored in an unheated area) is coupled to the pump, the temperature of the product could be substantially different from the temperature of the product used to calibrate the pump. To account for the effect of viscosity on the amount of product dispensed, the pump controller may use information regarding the temperature of the product to calculate the viscosity of the product, and adjusts pump activation periods accordingly.

In a fifth aspect of the invention, each pump controller may include a detection circuit that allows the pump controller to determine if the product container to which it is coupled is running low on product. To this end, the pump controller may include ports which may be coupled to product level probes that provide signals indicative of the amount of chemical product left in a product container coupled to the pump. In response to sensing that the product is running low, the pump controller may activate local alarms (such as a flashing LED or buzzer) and/or communicate the product level condition to the system controller over the serial data bus. In response to receiving a low level product condition message from the pump controller, the system controller may also activate a local alarm, and/or send an alarm message to the system operator through a network gateway.

To provide an out of product indication to the system, the pump controller may begin tracking the amount of chemical product dispensed beginning from the time at which a low level indication is received from a product level probe. If the low level indication is not cleared by refilling or replacing the container before a predetermined amount of additional product is dispensed, the pump controller may stop activating the pump and inform the system controller that the product has run out. Advantageously, this allows the chemical dispensing system to keep operating up until the point where a chemical product is about to run out, but prevents the system from operating without sufficient chemical product to properly process wash loads.

In an alternative embodiment, the pump may include an integrated out-of-product detection capability. This integrated out-of-product detection capability includes conductive plastic inserts in the flow path of the product so that the conductive plastic inserts are in contact with product passing through the pump. The conductive plastic inserts are electrically coupled to the detection circuit in the pump controller. The detection circuit is sensitive to the impedance between the inserts so that when product is present in the line between the inserts, the impedance presented causes the detection circuit to provide an indication to the pump controller that product is present. However, when product is not present in the line, such as if the pump begins drawing air from an empty chemical product container, the impedance between the conductive plastic inserts increases. This increase in impedance between the conductive plastic inserts, in turn, causes the detection circuit to provide an indication to the pump controller that the chemical product has run out. In response, the pump controller stops activating the pump and informs the system controller that the product has run out. Advantageously, this provides an additional mechanism that prevents the chemical dispensing system from operating when a chemical product has run out, thereby preventing the system from operating when there is insufficient chemical product to properly process wash loads. The pump controller may also activate local or remote alarms indicating an out product condition so that the condition is brought the attention of the system operator.

The system controller may include a selectable alarm notification feature that allows the system operator to select the types of alarms that are activated, as well as the time and duration of the alarms, based on the condition causing the alarm. Advantageously, this feature allows the system operator to customize the type of notification based on the perceived severity of the alarm. For example, alarms caused by conditions that do not immediately affect the performance of the system (such as low level alarms) may be logged in a productivity report maintained by the system controller, or could trigger a notification message sent through the network gateway to an e-mail address. Other more severe alarms (such as out of product alarms) may be configured to provide a more urgent indication, such as audible indicators (e.g., a buzzer) and/or visual indicators (e.g., a strobe light) at the system controller and/or pump-stand location.

In a sixth aspect of the invention, the pump controller provides a selectable flush manifold status monitoring feature. To this end, the pump controller includes an electrical input port that is operatively coupleable to one or more sensors in the flush manifold. The sensors (e.g., a flow switch) provide an indication of whether the flush manifold is ready to receive a dispensed chemical product. If the flush manifold is not ready to receive the dispensed chemical (e.g., the flow switch signal indicates that there is insufficient flow of diluent through the flush manifold), the pump controller refrains from activating the pump, and provides local and/or remote alarm notifications indicating the problem encountered.

In seventh aspect of the invention, the pump includes a pump chamber lid interlock system. The interlock system includes a sensor that provides a signal to the pump controller indicating the position of the pump chamber lid. For example, a magnet located in the pump chamber lid and a Hall Effect sensor located in the pump housing. In response to receiving a signal indicating that the pump chamber lid is open, the pump controller disables the pump. Advantageously, the pump chamber lid interlock system may thereby prevent injuries from pinched fingers and damage to the pump that may result if the pump is activated while a system operator is, for example, replacing a squeeze tube.

In an eighth aspect of the invention, the pump includes a housing that includes integral input and output channels and a motor having a horizontal orientation. The input end of the squeeze tube is coupled to a product supply line by the integral input channel, and the output end of the squeeze tube is coupled to a product delivery line by the integral output channel. The squeeze tube is thereby isolated by the pump housing from mechanical forces present on the supply lines. The squeeze tube is fluidically coupled to the input and output channels by 90 degree elbows so that the squeeze tube is oriented in a horizontal orientation. The 90 degree elbows are free to pivot inside the integral channels, and thereby allow axial motion at the ends of the squeeze tube. This axial motion is believed to further reduce mechanical stresses on the squeeze tube when the pump rotor is in motion, potentially extending squeeze tube service life. The 90 degree elbows also facilitate removal and replacement of the squeeze tube by allowing the squeeze tube to be in a horizontal position at a high point in the chemical product supply path. Gravity thus urges the chemical product to retreat back into the supply lines when the squeeze tube assembly is removed, reducing the likelihood of a spill.

The horizontal orientation of the motor facilitates positioning the rotor in a proper relationship with the horizontally oriented squeeze tube, and improves pump packaging. In an embodiment of the invention, the integral input and output channels are located in a back side of the pump housing so that the supply lines are positioned out of the way, and to facilitate use of European industry standard DIN rail system to secure the pumps comprising the pump stand to a vertical surface, such as a wall.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

Figure 1:
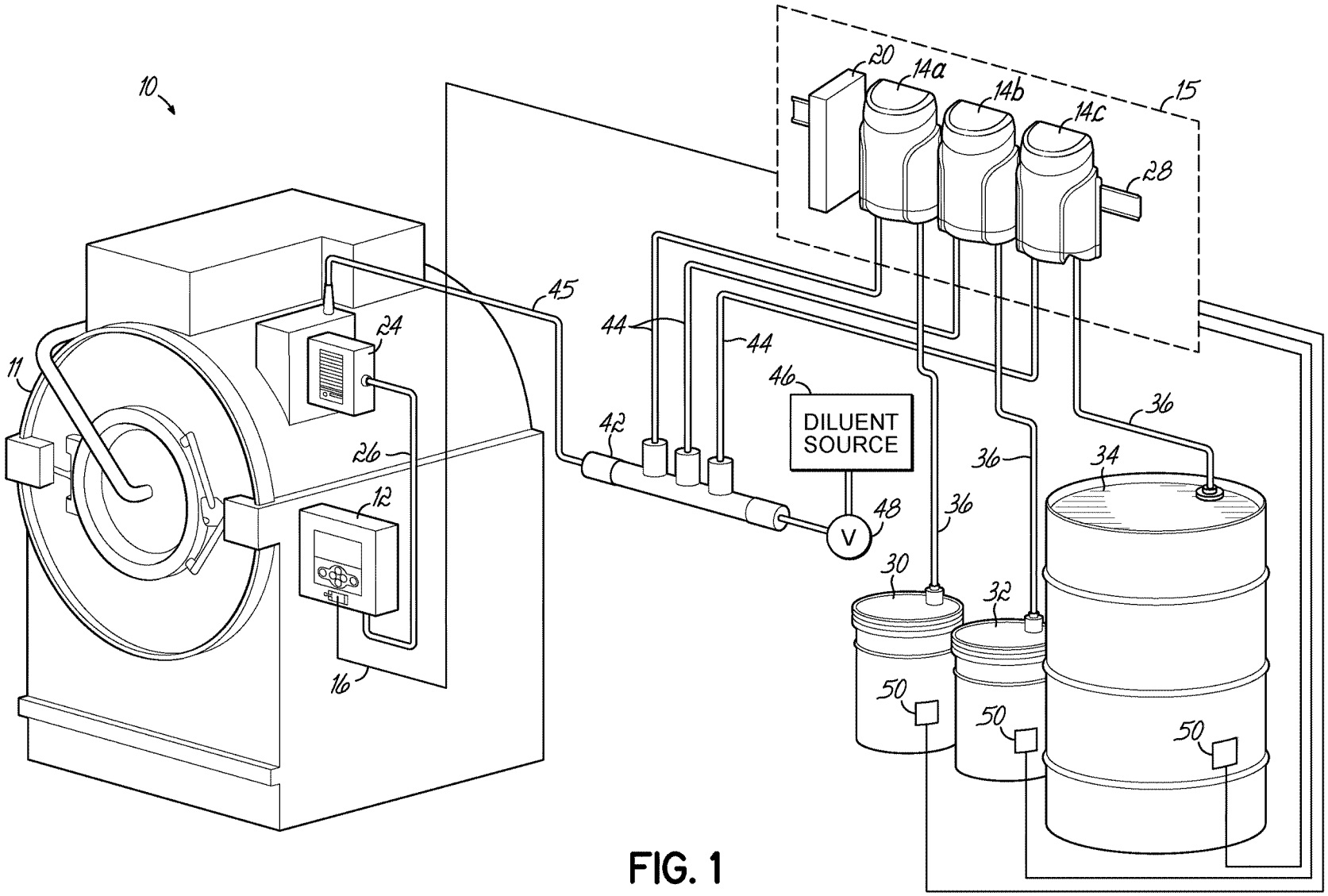
FIG. 1 is an illustration of an exemplary chemical dispensing system including a system controller, pump-stand, and machine interface.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and a clear understanding. In particular, thin features may be thickened, for example, for clarity or illustration.

DETAILED DESCRIPTION OF THE INVENTION

Embodiments of the invention provide a networked control system for dispensing chemical products in commercial washing machine applications that assists in overcoming the difficulties with contemporary chemical dispensing systems. In an embodiment of the invention, a system controller serves as a master controller and is linked via a plurality of serial data buses the other system nodes. The serial data bus interfaces provide an increased communications capability between the system controller and the system nodes as compared to conventional systems. The serial data buses thereby support adding intelligence to system nodes so that control functions may be distributed among the system nodes rather than concentrated in the system controller. By way of example, each pump controlled by the system includes a pump controller, which enables chemical product dispensing to be controlled locally in each pump based on commands received from the system controller over the serial data bus.

The serial data bus network allows the system controller to query the operational status of each of the other system components (such as a machine interface or any of a plurality of pump-stands) to determine if the system is ready to dispense chemicals before issuing commands. The serial data bus also provides power to network components so that additional nodes may be added to the network by simply daisy-chaining a new node to an existing node. This allows, for example, an additional pump to be added to an existing group of pumps comprising a pump-stand by merely coupling the new pump to the end of the chain of pumps with a jumper.

The system controller provides a user interface, stores process formulas, and displays system alarms and status indicators, as well as serving as the master controller for the serial data busses. To dispense chemical products according to a stored formula (e.g., a product dispensing profile for a particular process), the system controller sends data to one or more the pumps indicting the amount of chemical product that the pump stand is required to dispense. The system controller also periodically interrogates the pumps to verify that the pumps are operating properly. To this end, the system controller will typically query the status of a network node before issuing a command. The system controller may thereby obtain positive verification that the node is operating properly before issuing a command. The system controller may also include a serial data port configured to communicate with an optional network gateway. When present, the network gateway provides a data link between the system controller and an outside network, such as the Internet, so that system operators may communicate with one or more system controllers from a remote location.

To support the serial data bus network, each pump-stand includes a pump controller that provides local control of the pump motor and enables a data link process with the system controller. To this end, the pump controller includes a user selectable address that allows the system controller to address each pump controller individually over the shared serial data bus. The pump controller provides intelligence to the pump that supports more accurate dispensing of chemical product based on stored calibration data, monitoring and reporting of pump status, chemical product level monitoring, control of flush manifold operation (if present), and transmission of alarms to the system controller.

Figure 2:
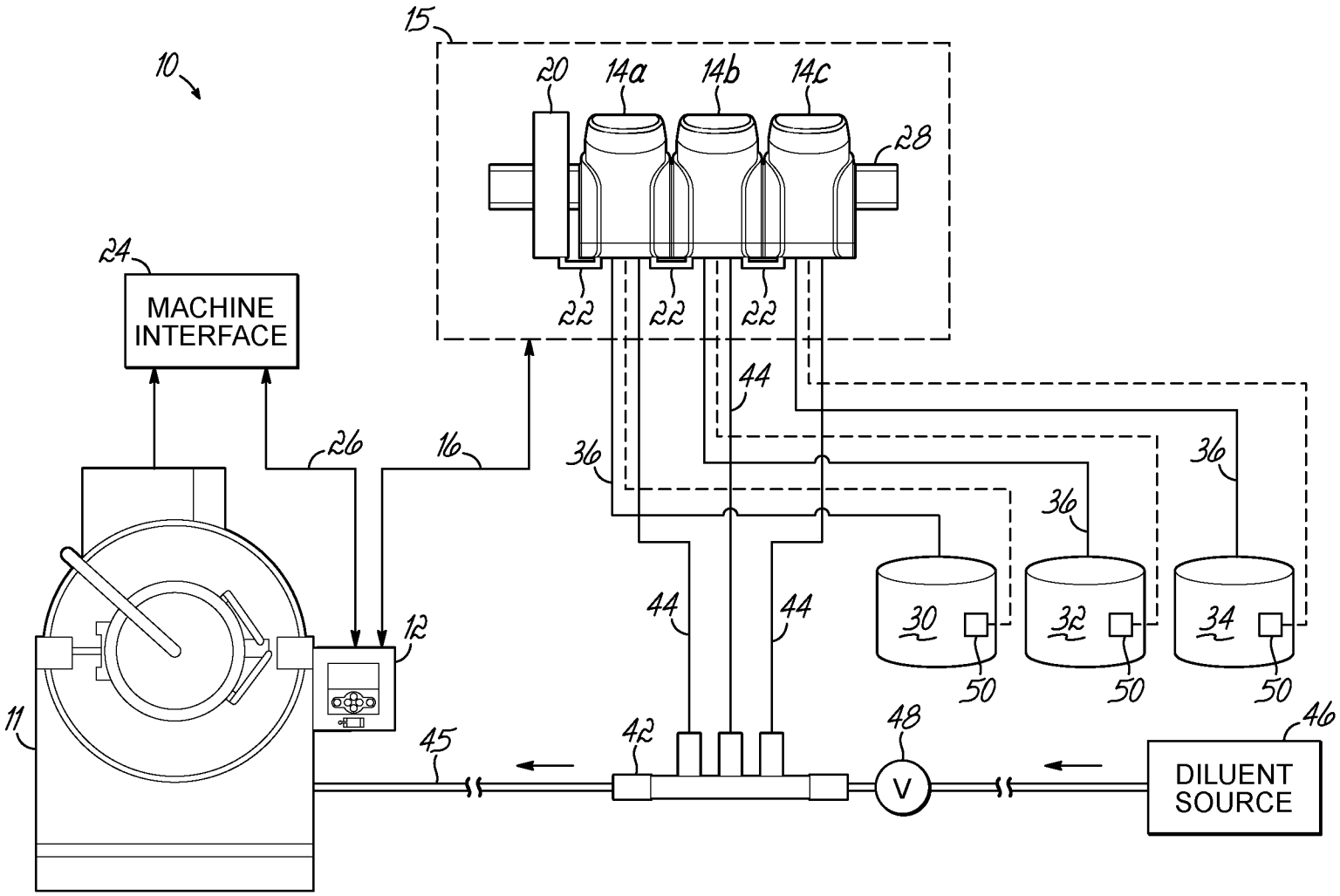
FIG. 2 is a schematic diagram of the chemical dispensing system in FIG. 1 illustrating the interconnectivity between the system controller, machine interface, pumps, washing machine, and chemical product containers in an embodiment of the invention where the system controller located with the washing machine.
Figure 3:
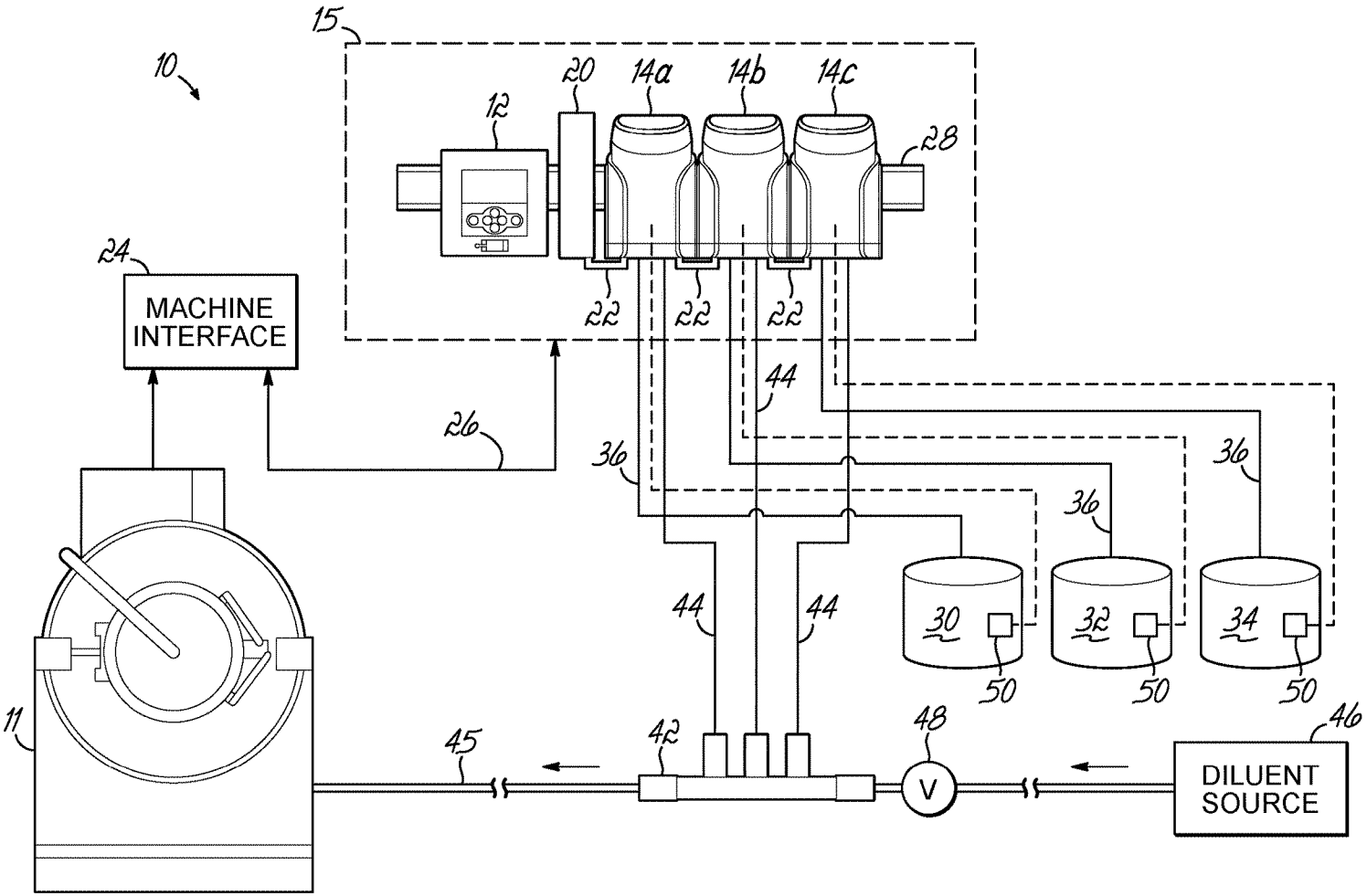
FIG. 3 is a schematic diagram of the chemical dispensing system in FIG. 2 with the system controller relocated to the pump-stand.
Figure 5:
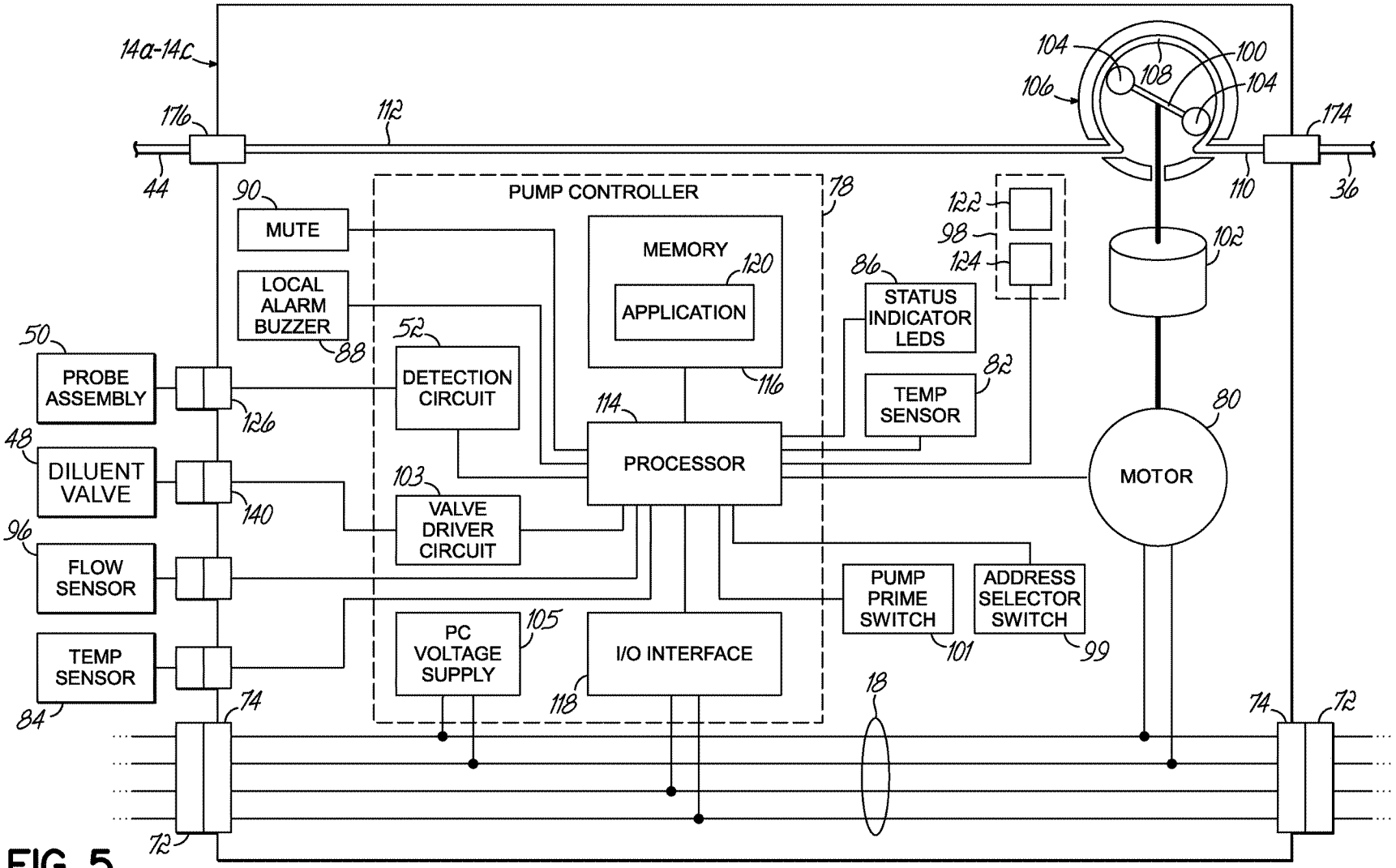
FIG. 5 is a schematic illustrating details of the pump including a pump controller and motor, as well as sensors and indicators associated with operation of the pump controller.
Figure 6A:
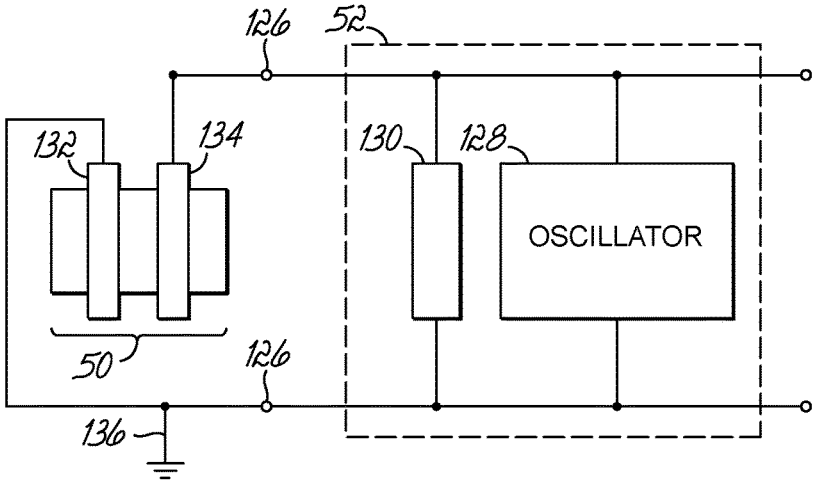
FIG. 6A is a detailed schematic of a detection circuit shown in FIG. 5 including an oscillator with an input coupled to a probe assembly.
Figure 6B:
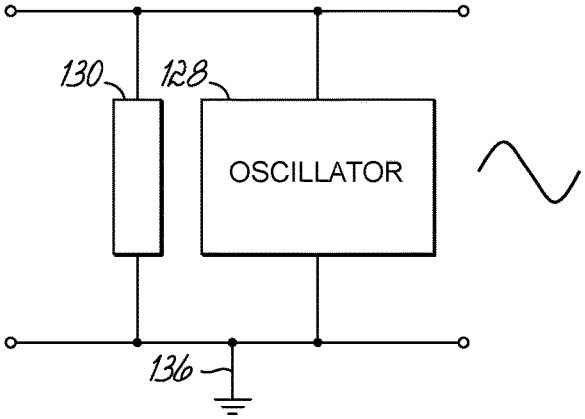
FIG. 6B is a schematic of the detection circuit in FIG. 6A with a high impedance being provided by the probe assembly showing the oscillator in an oscillating state.
Figure 6C:
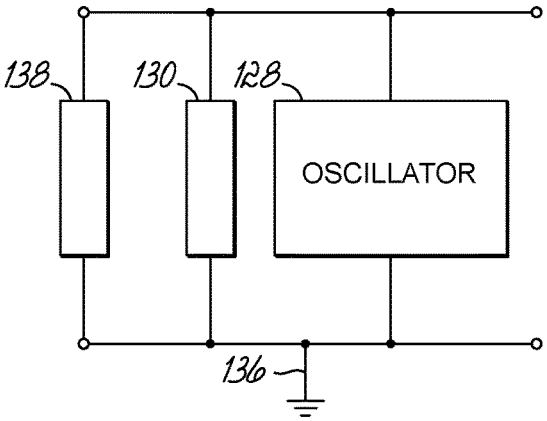
FIG. 6C is a schematic of the detection circuit in FIG. 6A with an impedance being provided by the probe assembly that causes the oscillator to be in a different state to include a non-oscillating state.

Referring now to the drawings, FIGS. 1-3 illustrate an exemplary chemical dispensing system 10 shown in two typical deployment configurations with a washing machine 11, which may be a laundry machine, a ware-wash machine, a healthcare wash, or any other type of machine that uses dispensed chemicals. One of ordinary skill in the art will recognize that this system 10 is only for illustration purposes and that embodiments of the invention may be used with other configurations of the chemical dispensing system 10. The base configuration of the chemical dispensing system 10 includes a system controller 12 coupled to a plurality of pumps 14*a*-14*c* comprising pump-stand 15 by a pump serial data bus 16. For illustrative purposes, FIGS. 1-3 show a system with 3 pumps 14*a*-14*c*. However, it is understood that other numbers of pumps may be used, and the invention is not limited to any specific number of pumps. The pumps 14*a*-14*c* each include a pass-through serial data bus connector 18 (FIG. 5) so that the pumps 14*a*-14*c* may be connected in a daisy-chain configuration on the pump-stand 15. Each pump 14*a*-14*c* is thereby connected to an adjacent pump by a jumper 22 so that the pumps 14*a*-14*c* are each electrically coupled to the pump serial data bus 16. The pump serial data bus 16 thus includes multiple jumpers 22 and pass-through connectors 18. In an embodiment of the invention, jumpers 22 may be comprised of a printed circuit board (PCB) encapsulated in plastic to facilitate quick connections between pumps 14*a*-14*c* and power supply 20.

System power is supplied by a power supply 20 mounted to the pump-stand 15 near one end of the chain of pumps 14*a*-14*c*. The power supply 20 may be coupled to the pump serial data bus 16 by connecting the output of the power supply 20 to one end of the pass-though connector 18 in the end pump, shown here as the left most pump 14*a*. The power supply 20 is thereby coupled to the pumps 14*a*-14*c* and the system controller 12 by the serial data bus 16. In a preferred embodiment, the pumps 14*a*-14*c*, and power supply 20 may be mounted to a DIN rail 28 on the pump stand 15, although the invention is not so limited, and other mounting locations and methods may be used.

To obtain data concerning the operational status of the washing machine 11, the system controller 12 is coupled to a machine interface 24 by a machine interface serial data bus 26. Typically, the system controller 12 will be located near (or mounted to) the washing machine 11 as shown in FIGS. 1 and 2, but the system controller 12 may also be located remotely from the washing machine 11 as shown in FIG. 3. For example, in the alternative embodiment illustrated in FIG. 3, the system controller 12 is mounted to the DIN rail 24 so that the system controller 12, pumps 14*a*-14*c* and power supply 20 are all affixed to the pump-stand 15 by the DIN rail 28.

The pump-stand 15 is configured to provide product to the washing machine 11 from various chemical storage containers 30, 32, 34, each of which is fluidically coupled to one of pumps 14*a*-14*c* by a product supply line 36. Typically, the output of each pump 14*a*-14*c* is fluidically coupled to a flush manifold 42 by flush manifold supply lines 44 as shown in FIGS. 1-3. However, the pumps 14*a*-14*c* may also be fluidically coupled directly to the washing machine 11 so that undiluted product is delivered to the machine 11. In embodiments including the flush manifold 42, an output of the flush manifold 42 is coupled to the washing machine 11 by a machine supply line 45, and an input of the flush manifold 42 is coupled to a diluent source 46 by a diluent valve 48. The diluent valve 48 may be electrically coupled to one or more of the pumps 14*a*-14*c*, (FIG. 5) so that the chemical dispensing system 10 can control delivery of product to the washing machine 11 by regulating the flow of diluent through the flush manifold 42.

The power supply 20 is typically mounted on the DIN rail 28 next to a pump 14*a*-14*c*, although other mounting locations may be used. The power supply 20 is connected to source of AC line voltage (not shown) and provides a DC voltage (such as to 24 VDC) suitable for powering system controller 12, pumps 14*a*-14*c*, and machine interface 24. When mounted on the DIN rail 28, the power supply 20 will typically be coupled to either the left side of pass-through connector 18 of rightmost pump 14*a*, (as shown); or to the right side of pass-through connector 18 of the leftmost pump 14*c*. Power is thereby distributed to the system controller 12 and pumps 14*a*-14*c* via the serial data bus 16. To this end, the serial data bus 16 may include power and ground conductors, as well as one or more data conductors. In an embodiment of the invention, the pump serial data bus 16 includes a power conductor, a ground conductor, a positive data conductor, and a negative data conductor. The data conductors thereby form a balanced, or differential, serial data transmission line. The system controller 12, in turn provides power to the machine interface 24 over the machine interface serial data bus 26, which is typically configured to have the same conductor layout as the pump serial data bus 16. Advantageously, the pass-through connectors 18 and pump serial data bus configuration make adding additional pumps to the pump-stand 15 a simple process, thereby facilitating the addition of additional chemical products to the chemical dispensing system 10.

Some embodiments of the invention may also include probe assemblies 50 operatively disposed in containers 30, 32, 34. The probe assemblies 50, in turn, may be electrically coupled to a detection circuit 52 (FIG. 5) in the pump 14*a*-14*c* that dispenses product from the container 30, 32, 34 in which the probe assembly 50 is located. Probe assemblies 50 may be configured to provide a signal to the detection circuit 52 indicative of the level of product in the container 30, 32, 34 so that the pumps 14*a*-14*c* may monitor product levels in their associated containers 30, 32, 34. Probe assemblies 50 are known in the art and typically include one or more conductive probes that present different impedances to the detection circuit 50 depending on whether the probe assembly 50 is in contact with product. Suitable probe assembles and detection circuits are described in U.S. patent application Ser. No. 13/164,878, entitled "System and Method for Product Level Monitoring in a Chemical Dispensing System", the disclosure of which is incorporated herein by reference in its entirety.

Figure 4:
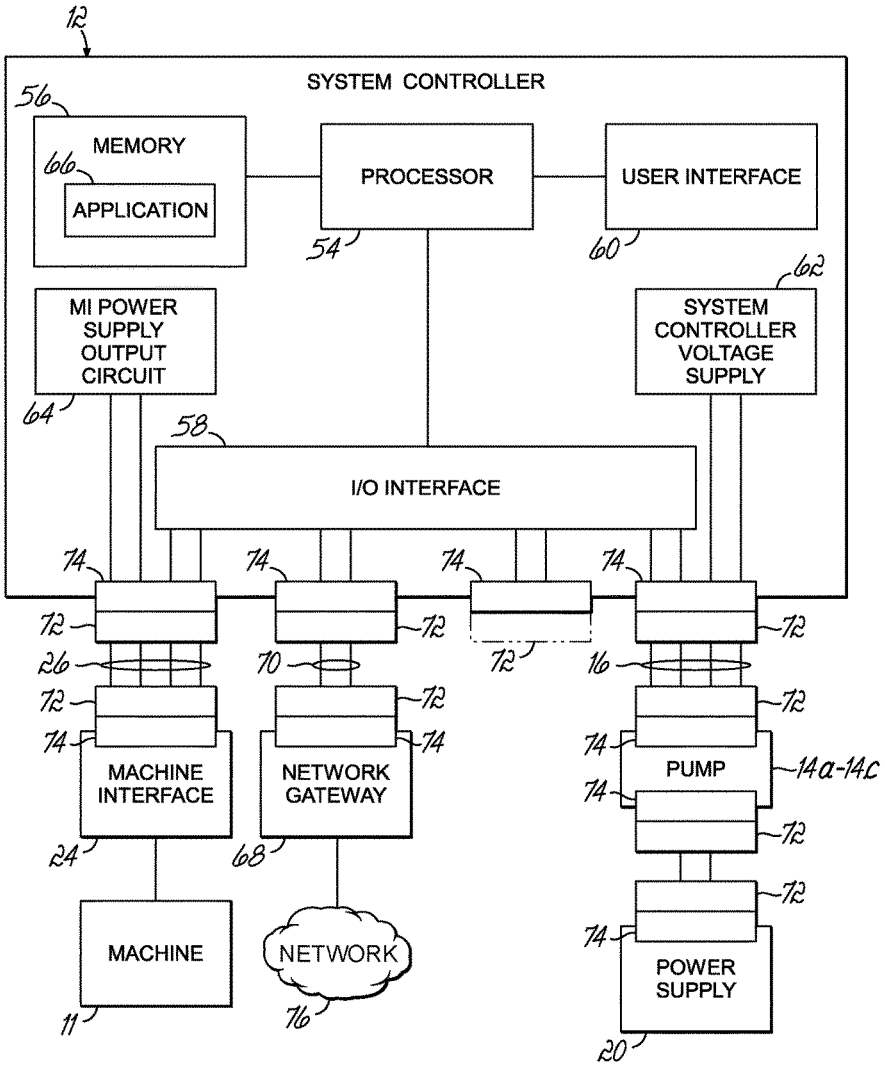
FIG. 4 is a schematic illustrating details of the system controller.

Referring now to FIG. 4 and in accordance with an embodiment of the invention, the system controller 12 includes a processor 54, memory 56, an input/output (I/O) interface 58, a user interface 60, a system controller voltage supply circuit 62, and a machine interface power supply output circuit 64. The I/O interface 58 is communicatively coupled to the processor 54 and employs a suitable communication protocol for communicating over the serial data busses. The processor 54 may thereby communicate through the I/O interface 58 to the machine interface 24 via the machine interface serial data bus 26, the pumps 14*a*-14*c* (shown as a single pump for purposes of illustration) through pump serial data bus 16, and a network gateway 68 via a network gateway serial data bus 70. The system controller 12 may also include one or more additional serial data bus interfaces 72 to accommodate future system expansion. The serial buses may be connected to the I/O interface 58 (as well as the various network nodes) though serial bus interfaces, each of which includes a suitable multi-pin connector 74.

Processor 54 may be a microprocessor, microcontroller, programmable logic or any other suitable device that manipulates signals based on operational instructions, which may be stored in memory 56. The memory 56 may be a single memory device or a plurality of memory devices including but not limited to read-only memory (ROM), random access memory (RAM), volatile memory, non-volatile memory, static random access memory (SRAM), dynamic random access memory (DRAM), flash memory, cache memory, and/or any other device capable of storing digital information. The memory 56 may also be integrated with the processor 54.

The processor 54 executes or otherwise relies upon computer program code, instructions, or logic (collectively referred to as program code) to execute the functions of the system controller 12. To this end, a system controller application 66 may reside in memory 56 and may be executed by the processor 54. The system controller application 66 controls and manages the chemical dispensing system 10 by communicating with other system components via the I/O interface 58 and serial data buses 16, 26, 70. The system controller application 66 may thereby obtain information regarding the operational status of the washing machine 11 from the machine interface 24, and in response, causes the pumps 14*a*-14*c* to dispense chemicals in a controlled way.

The user interface 60 may be operatively coupled to the processor 54 of the system controller 12 in a known manner. The user interface 60 includes output devices, such as alphanumeric displays, one or more touch screens, light emitting diodes (LEDs), acoustic transducers, and/or any other suitable visual and/or audio indicators; and input devices and controls, such as the aforementioned touch screen, an alphanumeric keyboard, a pointing device, keypads, pushbuttons, control knobs, etc., capable of accepting commands or input from the system operator and transmitting the entered input to the processor 54. The user interface 60 thereby provides a mechanism by which the system operator may enter new washing process formulas, set and/or deactivate alarms, update calibration data, retrieve and view system data (such as amounts of product dispensed and number and type of wash loads run) and otherwise operate and manage the chemical dispensing system 10.

The system controller voltage supply 62 receives power from the power supply 20 via the pump serial data bus 16. The system controller voltage supply may contain circuits, such as voltage regulators, that condition and adjust the voltage received from the power supply 20, thereby providing suitable voltages for running the processor 54 and other system controller components. The machine interface power supply output circuit 64 may receive power from the system controller voltage supply 62, or directly from the power supply 20 via the pump serial data bus 16. The machine interface power supply circuit 64 may condition the power before transmitting it to the machine interface 24; or the machine interface power supply circuit 64 may merely pass the power received from the power supply 20 on to the machine interface 24 over the machine interface serial data bus 26 without significant alteration.

The network gateway 68 may be a computer equipped to provide an interface between the system controller 12 and an external network 76, such as the Internet. To this end, the network gateway 68 may include a network gateway application running on a processor that performs protocol translation, converts data rates, and/or provides any other functions necessary to provide interoperability between the chemical dispensing system and the external network. The network gateway 68 may thereby allow computers or other communication devices that are attached to the external network 76 to communicate with the system controller 12 so that system operators may remotely control and monitor the chemical dispensing system 10. The network gateway 68 may also be configured to address multiple system controllers 12 over a single network gateway serial data bus 70.

Referring now to FIGS. 5 and 6A-6C, each pump 14*a*-14*c* includes a pump controller 78 in communication with a motor 80. The pump controller 78 may also be in communication with the detection circuit 52, internal and external temperature sensors 82, 84, a plurality of status indicator LEDs 86, a local alarm buzzer 88, a mute switch 90, a flow sensor 96, a pump chamber lid sensor 98, address selector switch 99, pump prime switch 101, and a valve driver circuit 103. The pump controller 78 may also include a pump controller voltage supply 105 that provides suitable voltage levels for running the controller components. The motor 80 may be a brushless direct current (BLDC) electric motor coupled to a rotor 100 by a transmission 102. The rotor 100 includes one or more rollers 104 and is positioned in a pump chamber 106 with a squeeze tube 108. The rotor 100, pump chamber 106, and squeeze tube 108 are further configured so that when torque is applied to the rotor 100 by the motor 80, the rotor 100 rotates in such a way that the rollers 104 compress the squeeze tube 108 against a side wall of the pump chamber 106 in a progressive fashion that causes fluid to be urged through the squeeze tube 108.

So that the pump 14*a*-14*c* may dispense product, one end of the squeeze tube 108 is coupled to an integral input channel 110, and the other end of the squeeze tube 108 is coupled to an integral output channel 112. The integral input and output channels 110, 112 are in turn fluidically coupled to the product supply and flush manifold supply lines 36, 44, respectively. Activating the motor 80 thereby causes fluid to be drawn into the squeeze tube 108 from the product supply line 36 via the integral input channel 110 and expelled into the flush manifold supply line 44 via the integral output channel 112. Product may thereby be conveyed from the product container 30, 32, 34 to the flush manifold 42 by pumps 14*a*-14*c*.

Similarly as described with respect to the system controller 12, the pump controller 78 includes a processor 114, memory 116, and an I/O interface 118 that provides a communications link between the pump controller processor 114 and the pump serial data bus 16 via the pass-through connector 18. The pump controller processor 114 may be further operatively coupled to detection circuit 52, motor 80, internal and external temperature sensors 82, 84, status indicator LEDs 86, local alarm buzzer 88, mute switch 90, flush manifold flow sensor 96, pump chamber lid sensor 98, address selector switch 99, pump prime switch 101, and valve driver circuit 103.

Memory 116 may contain a pump controller application 120 comprised of program code that, when executed by the processor 114, causes the pump controller 78 to provide local motor control and support a data link process that allows the system controller 12 and pump controller 78 to communicate over the pump serial data bus 16. The address selector switch 99 may be any suitable switch, such as a rotational selector switch or dip switch that is accessible from the outside of the pump 14*a*-14*c*. Advantageously, the address selector switch 99 thereby provides a quick and easy means to visually identify the current address of each pump controller 78 in the network.

Each pump controller 78 that is sharing the pump serial data bus 16 has a unique address that is set on the address selector switch 99 prior to applying power to the pumps 14*a*-14*c*. The pump controller application 120 reads the address selector switch at power up and loads the network address into memory 116. Once the pump controller application 120 has loaded the network address into memory, the network address will remain fixed so long as the pump controller 78 is under power. Advantageously, this feature reduces the risk of the pump controller's network address being changed inadvertently while the system 10 is in operation, which could result in more than one pump controller 78 having the same network address. To change the network address of the pump controller 78, the system operator must power down the pump stand 15, change the configuration of the address selector switch 99, and reapply power so that the new address is loaded by the pump controller application 120.

The pump prime switch 101, when enabled, provides an automated pump priming function. To prevent inadvertent activation of the priming function, the operation of the pump prime switch 101 may have to be enabled in the system controller 12 through a password protected menu accessed through the system controller user interface 60. Enabling the pump prime function in the system controller 12 causes the system controller application 66 to set a priming feature enable flag in the pump controller 78. In response to sensing that the pump prime switch 101 has been activated, the pump controller application 120 checks the priming feature enable flag. If the flag is set, the pump controller application 120 activates the motor 80 for a sufficient amount of time to ensure that the supply lines 36, 44 and pump 14*a*-14*c* are primed with product. In contrast, if the feature enable flag is not set, the pump controller application 120 may simply ignore the state of the pump prime switch 101.

The pump chamber lid sensor 98 provides a signal indicative of the position of a pump chamber lid 178 (FIG. 9) to the processor 114. To this end, the lid sensor 98 may include a magnet 122 and a Hall Effect sensor 124 configured to provide a first signal to the processor 114 when the lid 178 is in an open position, and a second signal to the processor 114 when the lid 178 is in a closed position. To reduce the risk of damage to the pump 14*a*-14*c* as well as injury to the system operator, the pump controller application 120 checks the pump chamber lid sensor signal before activating the motor 80. If the signal indicates that the pump chamber lid 178 is in a closed position, the pump controller application 120 will activate the motor in the normal manner. However, in response to a signal indicating that the pump chamber lid 178 is in an open position, the pump controller application 120 may disable the motor 80 as well as provide an indication to the system controller 12 that the motor 80 is not in a condition to be activated.

The detection circuit 52 supports a low level detection feature, which may be enabled in the pump controller application 120 by activating the feature through the system controller user interface 60. The detection circuit 52 includes in input port coupleable to the probe assembly 50 through a probe assembly connector 126, which may be located on the bottom of the pump 14*a*-14*c*. The detection circuit 52 includes a low frequency oscillator that includes an active element, or oscillator 128 (FIGS. 6A-6C) and a load element 130. The oscillator 128 may include a CMOS inverter or any other suitable device capable of producing an oscillation when coupled to load element 130. Load element 130 may be a resistor-capacitor (RC) circuit or some other suitable circuit that provides a suitable load or feedback to the oscillator 128 to cause the oscillator 128 to oscillate. The detection circuit 52 produces an oscillation when a high impedance electrical load is present on the input to the probe assembly connector 126, such as an electrical load with an impedance greater than 5 megohms. The detection circuit 52 thereby provides a low frequency oscillation signal when the quality factor of the oscillator 128 is sufficiently unaltered by the electrical load from a probe assembly 50 that is not in contact with a monitored product. When an electrical load that has a high impedance is coupled to the input 126, the oscillator 128 comprising detection circuit 52 is tuned to oscillate at a nominal operating frequency, such as about 10 Hz, for example. The pump controller application 120 may thereby determine if there is sufficient product remaining to contact the probe assembly 50 by monitoring the output of the detection circuit 52 for an oscillation.

A pair of conductive probes 132, 134 comprising the probe assembly 50 may be connected to the detection circuit 52. The probe assembly 50 is connected across the input 126 of the detection circuit 52 so that one probe 132 is connected to one side of load element 130 and the other probe 134 is connected to the other side of load element 132, which may also be coupled to a reference ground 136. When the probe assembly 50 is suspended in air, such as when the product in the monitored container 30, 32, 34 has dropped below the probe assembly 50, the impedance of the probe assembly 50 as seen by the detection circuit 52 has a low loading effect on the oscillator 128. The quality factor of the oscillator 128 is thus relatively unaffected by the presence of the probe assembly 50 so that the detection circuit 52 outputs a time varying voltage signal at the nominal frequency as illustrated in the schematic diagram of FIG. 6B.

However, when one or both of the probes 132, 134 are in contact with a conductive solution, an impedance 138 from the probes 132, 134 is seen by the detection circuit 52. A typical impedance between the probes 132, 134 when in contact with product will be between 10 kilohms and 1 megohms. The impedance 138 will lower the quality factor of the oscillator 128, which changes the operating parameters of the oscillator 128 due to the parallel loading effect of the probe assembly 50. These changed parameters will cause the oscillator 128 to oscillate at a frequency different from the nominal frequency or to cease oscillating depending on the load presented by the probe assembly 50, as illustrated in the schematic diagram of FIG. 6C. Thus, in response to being coupled to a probe assembly 50 that is in contact with product, the detection circuit 52 will output a signal having a different frequency or that stops varying altogether, such a constant voltage at ground potential. This change in the output of the detection circuit 52 thereby provides an indication to the processor 114 of the presence or absence of product at the probe assembly 50.

The status indicator LED's 86 may include a first LED that provides a visual indication that the pump 14*a*-14*c* is powered, a second LED that provides an indication of the presence of data traffic on the pump serial data bus 16, a third LED to indicate if a local error is active, and a fourth alarm LED that provides an indication of the level of product detected by the pump controller application 120. The power and data traffic status indicator LEDs may be coupled to and activated by the processor 114, or may be directly tied to a pump power supply and/or data lines as the case may be. The alarm LED may be used to indicate a variety of conditions. By way of example, the pump controller application 120 may cause the alarm LED to flash when a probe assembly 50 is coupled to the detection circuit and the product level feature is active to provide an indication of such to the system operator. In response to detecting a low product condition, the pump controller application 120 may cause the alarm LED to be illuminated continuously so that the system operator is provided with a visual indication of the low product level condition.

The pump controller application 120 may also be configured to activate the local alarm buzzer 88 in response to detecting a low product level condition. The system operator may cause the pump controller application 120 to silence the alarm buzzer 88 by pressing mute switch 90. In some embodiments, the pump controller application 120 may send an alarm message to the system controller 12 in response to a status query so that the system controller 12 may activate an alarm or otherwise report to the system operator that an alarm condition exists at the pump-stand 15. The pump controller application 120 may be configured to provide different mute responses depending on how long or how many times the mute switch 90 is activated. By way of example, in some embodiments of the invention, the first time the mute switch 90 is pressed, the alarm might be silenced for a short period, such as an hour. If the mute switch 90 is held down for a length of time, such as 3-4 seconds, the alarm might be silenced for a longer period, such as a weekend. To provide an indication that the local alarm buzzer 88 has been muted, the local alarm LED may be made to flash at a slower rate than normal. The rate of flashing may be further adjusted so that the local alarm LED flashes at a slower rate when a long duration alarm silencing period has been activated (such as a weekend) than when a short duration silencing period has been activated (such as an hour).

The pump-stand 15 may be configured to deliver product directly to the washing machine 11, or the product may be dispensed into the flush manifold 42 and delivered to the machine 11 by a diluent, which is the configuration illustrated in FIGS. 1-3. When the pump-stand 15 is deployed with flush manifold 42, a flush-flow control feature may be activated in the pump controller application 120 of at least one of the pumps 14*a*-14*c* associated with the system controller 12. As with the previous optional features, the flush-flow feature is activated in the pump controller application 120 through the user interface 60 of the system controller 12. Typically, the flush flow feature is only activated in one pump 14*a*-14*c* per pump-stand 15, with the system controller 12 controlling the flush manifold 42 by addressing flush manifold related commands to the pump controller 78 that is coupled to the diluent valve 48. In order to provide sufficient drive current and voltages to the diluent valve 48, the processor 114 may be coupled to the diluent valve 48 by a valve circuit driver 103. In cases where the valve circuit driver 103 is not coupled to the diluent valve 48, the valve circuit driver output port 140 may be used to provide a switched voltage output, such as a 24 VDC switched output, for activating external alarms or other uses.

The pump controller application 120 may also monitor the flow sensor 96, which provides a signal indicative of the rate that diluent is flowing through the flush manifold 42. The pump controller application 120 may thereby make determinations concerning the dispensing of product into the flush manifold 42 based on whether there is sufficient diluent flow to deliver the product to the washing machine 11. The pump controller application 120 may also report alarm conditions to the system controller 12 if the detected diluent flow rate deviates from an acceptable level.

Figure 7:
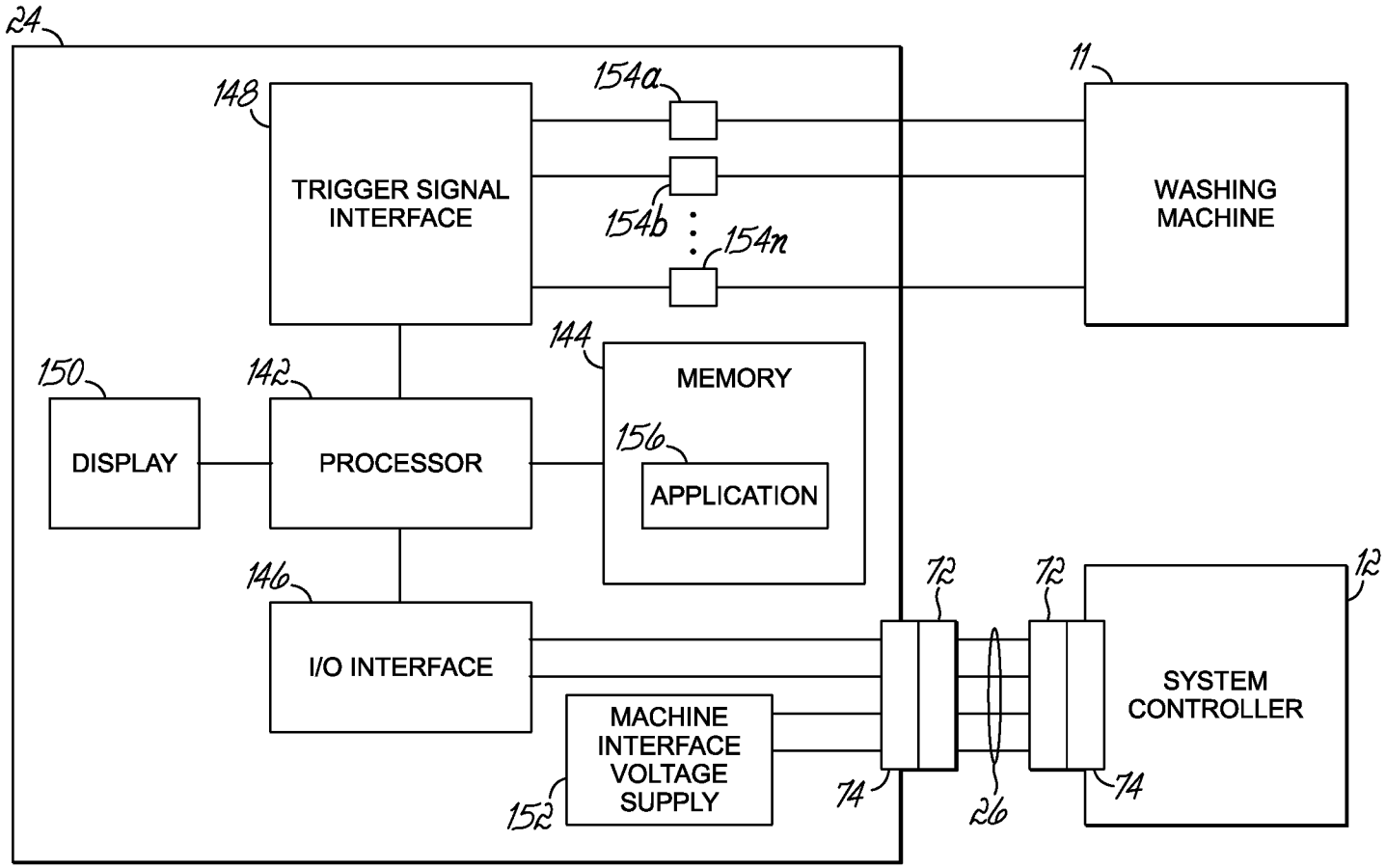
FIG. 7 is a schematic illustrating additional details of the machine interface presented in FIGS. 1-3.

Referring now to FIG. 7, the machine interface 24 includes a processor 142 that is operatively coupled to a memory 144, an I/O interface 146, a trigger signal interface 148, and a display 150. A machine interface voltage supply 152 is coupled to and receives power from the machine interface serial data bus 26, and includes voltage regulation circuits that provide suitable voltages to the circuits comprising the machine interface 24. The trigger signal interface 148 is coupled to trigger signals in the washing machine 11 by optical isolators 154*a*-154*n*, which provide galvanic isolation between the high voltage triggers in the washing machine 11 and the other chemical dispensing system components. In an embodiment of the invention, there may be 10 trigger signals, with each signal being coupled to the trigger signal interface by an optical isolator 154*a*-154*n*.

Memory 144 may contain a machine interface application 156 comprised of program code that, when executed by the processor 142, causes the machine interface 24 to determine the operational state of the washing machine 11 based on machine trigger signals detected by the processor 142 via the trigger signal interface 148. The machine interface application 152 may also handle the networking and messaging functions required to communicate with the system controller 12 over the machine interface serial data bus 26. To this end, the I/O interface 146 may employ a suitable communication protocol for communicating over the machine interface serial data bus 26. In an embodiment of the invention, the machine interface 24 is configured as a slave module, and will only respond back to the system controller 12 in response to being queried by the system controller 12.

The trigger signal interface 148 works cooperatively with optical isolators 154*a*-154*n* to convert the local high voltage trigger signals received from the washing machine 11 into signals suitable for coupling to the processor 144. The machine interface application 156 determines the state of the washing machine 11 based on the detected trigger signals, and may store time stamped trigger signals in memory 144 for later use and reporting. In response to a query from the system controller 12, the machine interface application 152 communicates the determined state of the machine 11 and/or detected triggers to the system controller application 66. In response to the washing machine state (e.g., beginning wash cycle), the system controller application 66 may, in turn, cause the pump controller application 120 to dispense product to the washing machine 11 (e.g., dispense 100 milliliters of detergent). The machine interface display 150 may include an electronic membrane overlay having LEDs that are illuminated by the machine interface application 156 to indicate the particular triggers that have been detected and qualified. The display 150 may also include an additional LED that is illuminated to indicate the presence of data traffic on the machine interface serial data bus.

Figure 9:
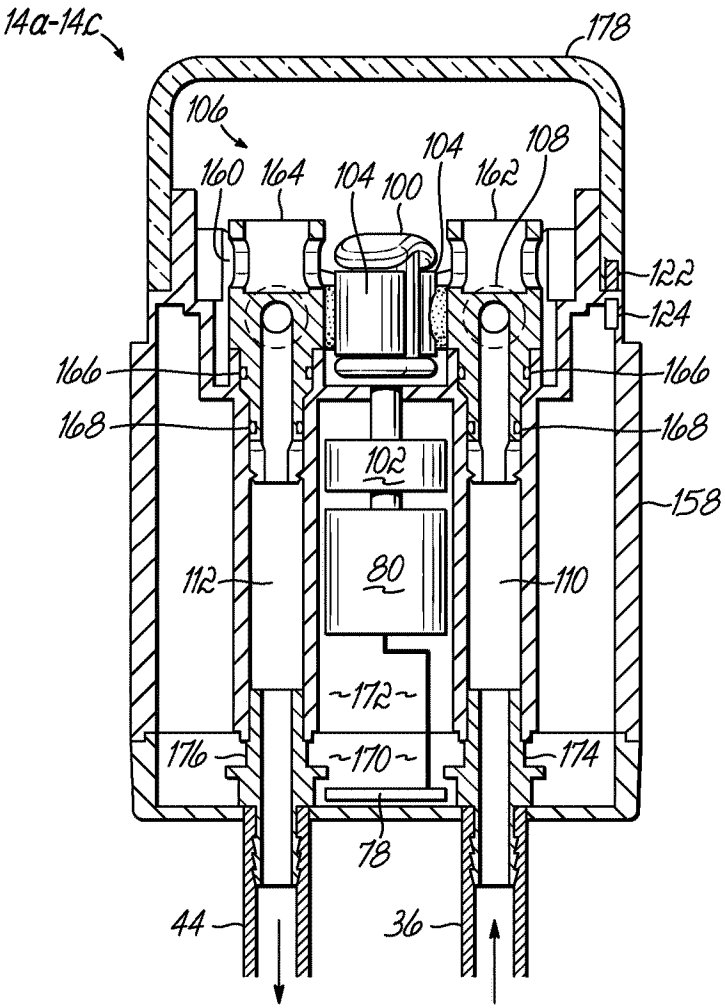
FIG. 9 is a cross-sectional diagram of the pump in FIG. 8 illustrating the integral input and output channels.
Figure 8:
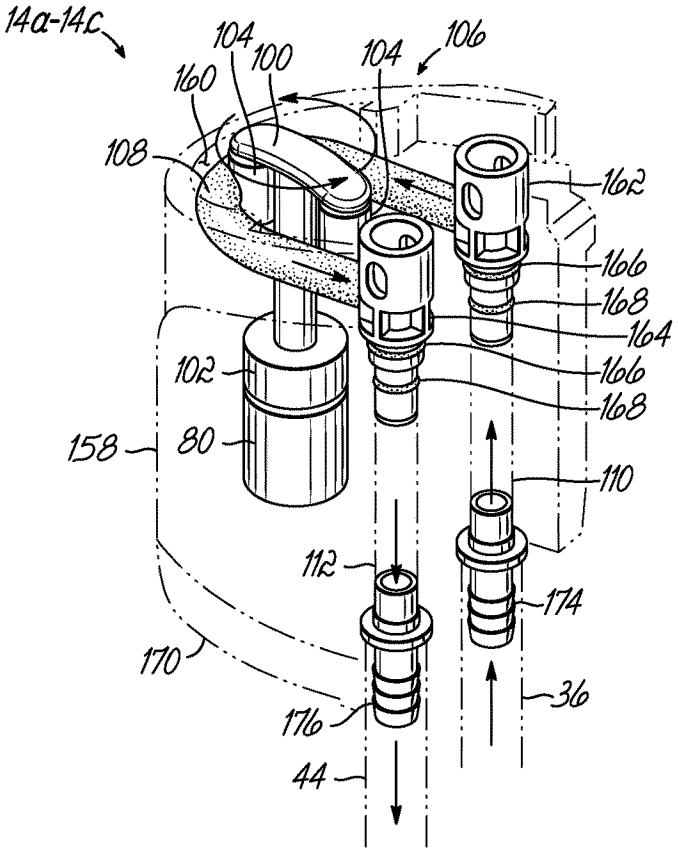
FIG. 8 is an isometric view of the pump illustrating features of the pump housing and pump components.
Figure 10:
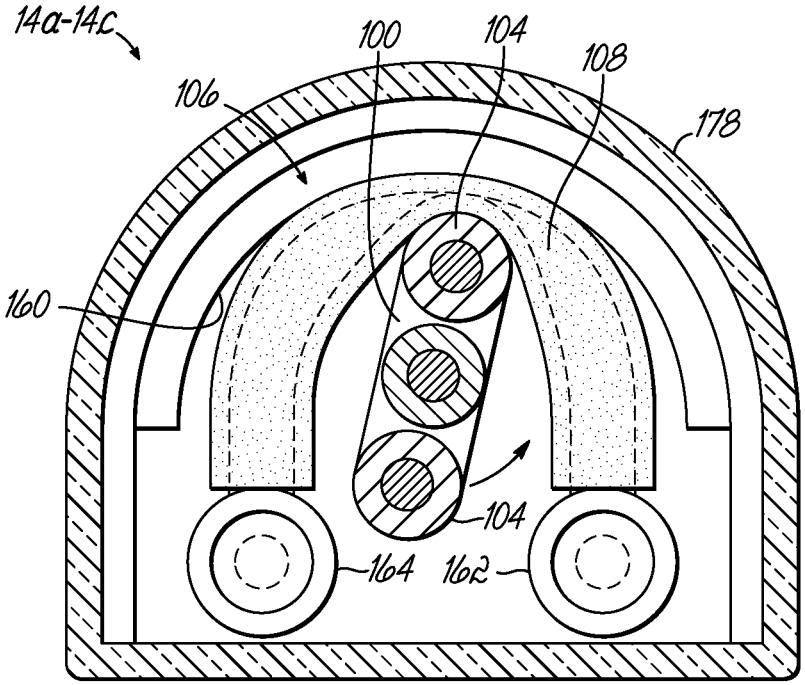
FIG. 10 is a top view of the pump illustrating the squeeze tube, rotor, and pump chamber.

With reference to FIGS. 8-10, in which like reference numerals refer to like features in FIGS. 1-7 and in accordance with an embodiment of the invention, the representative pump 14*a*-14*c* includes a housing 158 having a pump chamber 106, an integral input channel 110, and an integral output channel 112. The rotor 100 and squeeze tube 108 are positioned in the pump chamber 106, and the rotor 100 includes rollers 104 configured to compress the squeeze tube 108 against a sidewall 160 of the pump chamber 106. The squeeze tube 108 has a first end coupled to the integral input channel 110 by an inlet fitting 162 and a second end coupled to the integral output channel 112 by an outlet fitting 164. The inlet and outlet fittings 162, 164 include a 90 degree elbow so that the squeeze tube 108 is oriented in a plane perpendicular to the integral input and output channels 110, 112. Each fitting 162, 164 includes upper and lower o-rings 166, 168 that provide a fluid-tight seal between the fitting 162, 164 and its respective integral channel 110, 112. Advantageously, the o-rings 162, 164 allow the fittings 162, 164 to pivot axially, which may reduce lateral bending forces on the squeeze tube 108 at the squeeze tube/fitting connection points.

The pump controller 78 and associated circuits are mounted in a lower cavity 170 near the bottom of the pump housing 158 to facilitate access to the various electrical connectors associated with the pump controller 78. The pump motor 80 and transmission 102 are stacked vertically in a central cavity 172, so that the motor 80 has a horizontal orientation. The transmission 102 may provide speed and torque conversion between the motor 80 and rotor 100 so that the rotor rotates at a desirable speed. In an alternative embodiment of the invention, the transmission 102 may be omitted and the motor 80 directly coupled to the rotor 100. The motor 80 may be a brushless DC motor, and may include an integrated motor controller (not shown) that provides signals indicative of the motor speed in rotations per minute to the pump controller processor 114. Advantageously, the integrated motor controller thereby allows the pump controller application 120 to determine and report motor status (such as a locked rotor condition) as well as precisely measure product volume dispensing by tracking the speed and/or number of rotations of the rotor 100.

The product and flush manifold supply lines 36, 44 are coupled to the integral input and output channels 110, 112 by plastic inserts 174, 176, respectively. Plastic inserts 174 and 176 may include a threaded upper end configured to engage the lower ends of the integral input and output channels 110, 112. The plastic inserts 174, 176 each include a barbed lower end that provides a fluid tight seal when coupled to the product and flush manifold supply lines 36, 44. In an embodiment of the invention, the plastic inserts 174, 176 may be comprised of a conductive plastic, such as carbon impregnated polypropylene. In this alternative embodiment, the conductive plastic inserts 174, 176 may be electrically coupled to the detection circuit 52 and thereby serve as integrated conductive probes 132, 134 that provide an out-of-product indication to the detection circuit 52.

The pump chamber lid 178 may be comprised of transparent plastic that allows system operators to view the operation of rotor 100 and squeeze tube 108. The magnet 122 is positioned within the pump chamber lid 178 so that when the lid 178 is closed, the magnet 122 causes the Hall Effect sensor 124 to change its output, indicating to the pump controller application 120 that the pump chamber lid 178 is in a closed position. When the pump chamber lid 178 is opened, the change the magnetic field in the region of the Hall Effect sensor 124 causes the Hall Effect sensor to provide a signal to the pump controller application 120 that indicates the lid 178 is not closed. In response, the pump controller application 120 may disable the motor 80 to reduce the risk of injury to system operators and/or damage to the squeeze tube 108 from fingers or other objects becoming entangled with the rotor 100.

In operation, the system controller 12 may be configured as a master, and the machine interface 24 and pump controllers 78 configured as slaves. Using this master/slave configuration, the machine interface 24 and pump controllers 78 only communicate with the system controller 12 in response to a query or other message from the system controller 12. This master/slave arrangement thus ensures that only one system node transmits data over their associated serial data bus at a time. Process formulas are programmed into the system controller 12 over the user interface 60, and the system operator selects which chemical dispensing process formula the system controller 12 will implement based on the type of load the washing machine 11 is processing. The system controller 12 is thus the master controller in the network and handles all of the process formulas and any required mathematical calculations, as well as providing a human-machine interface to the chemical dispensing system 10.

Operations in the chemical dispensing system 10 are initiated by the system controller 12 querying the status of the machine interface 24. To this end, the system controller application 66 sends a status query message to the machine interface 24 over the machine interface data bus 26. The machine interface application 156 responds to the status query message with a status update that includes data regarding any qualified triggers that have been logged by the machine interface 24 since the last query message the system controller 12. In response to the content of the machine controller response message, the system controller application 66 determines the state of the washing machine 11. Based on the state of the washing machine 11 and the process formula selected by the system operator, the system controller application 66 further determines which product, if any, needs to be dispensed as well as how much of the product should be dispensed. All pump operations are thus ultimately dependent on the qualified triggers, which are processed locally by the machine interface 24 and sent to the system controller 12 by the machine interface 24 when prompted.

If the washing machine 11 is in a state requiring product to be dispensed (e.g., beginning a wash load), the system controller application 66 queries the status of the pump 14*a*-14*c* associated with the container 30, 32, 34 holding the product to be dispensed. To this end, the system controller application 66 sends a query message addressed to the pump controller 78 associated with the product to be dispensed over the pump serial data bus 16. The pump controller application 120 responds to the query message by reporting back pump status, including any out of product or other system alarms, which (if present) are displayed by the system controller 12.

If the pump controller application 120 response indicates that the pump 14*a*-14*c* is ready to dispense product, the system controller application 66 will determine the amount of product that is to be dispensed, and communicate this to the pump controller application 120. Advantageously, by sending data to the pump 14*a*-14*c* that allows the pump controller 78 to determine a required run time rather than merely a pump OFF/ON command (as is conventional), the system 10 ensures that the motor 80 will not run continuously if the system controller 12 loses communication with the pump controller 78 after the motor 80 has been activated.

In response to receiving the dispense product message from the system controller 12, the pump controller application 120 checks the pump status to verify that the pump 14*a*-14*c* is ready to dispense product (i.e., there are no active alarms that would preclude dispensing product), and activate the motor 80 for an amount of time or number of rotations calculated to dispense the required amount of product. The pump controller 78 may accumulate the total motor activation time and/or number of rotations (collectively referred to as an activation period) and store this value in memory 116. The accumulated activation period value may be used in estimating remaining squeeze tube service life and/or a deterioration in pump flow rate due to wear on the squeeze tube 108. The pump controller application 120 may also open the diluent valve 48 (when present) for an amount of time sufficient to flush the product into the washing machine 11, and may monitor the flow sensor 96 to ensure that sufficient diluent flow is present. In response to the pump controller application 120 determining that the required amount of product has been delivered to the washing machine 11, the application 120 notifies the system controller 12 that the dispensing operation is complete. If the pump controller application 120 determines that the required amount of product was not delivered to the washing machine 11, the application 120 may send an alarm or other error message to the system controller 12 so that the system controller 12 can notify the system operator.

To increase the reliability of communications over the serial data bus network, the system controller 12 may make several attempts to deliver data packets to the system nodes if no response is received to earlier transmissions. The machine interface and pump serial data bus protocols may include both acknowledge (ACK) and negative-acknowledge (NACK) response messages to fully validate system node operation, and may also include cyclic redundancy checking (CRC) to further ensure data robustness.

The system controller 12 may periodically interrogate the pumps 14*a*-14*c* to monitor the performance of the motor 80, squeeze tube 108, and any other system errors or alarms. By way of example, the pump controller 78 may track the amount of pump activation time and/or number of rotations to which the squeeze tube 108 has been subjected and use this data to estimate the remaining service life of the squeeze tube 78. The system controller 12 may obtain operational data from the pump controller 78 regarding the estimated remaining squeeze tube service life and display this data in a squeeze tube life menu over the user interface 60. The system controller 12 may also include a menu selection that allows the system operator to reset the percentage of life remaining statistic for an individual pump 14*a*-14*c* when that pump's squeeze tube 108 is replaced. The system controller 12 may also generate system maintenance alerts or alarms based on this squeeze tube percentage of life remaining exceeding a lower threshold (e.g., below 5%), which may be settable by the system operator. Advantageously, by closely monitoring the percentage of life remaining, the system controller 12 and/or pump controller 78 may adjust the run time of the motor 80 to compensate for reductions in the volume of product dispensed due to tube wear. More advantageously, by actively monitoring squeeze tube life, the replacement schedules for squeeze tubes 108 may be extended while simultaneously reducing the risk of squeeze tube failure, thereby reducing overall system maintenance costs.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. For example, as is understood by a person having ordinary skill in the art, the various functions and methods described herein may be distributed between the system, pump, and machine interface controllers in various ways and combinations, so that any controller in the system may perform functions currently ascribed to another controller. The invention in its broader aspects is therefore not limited to the specific details, representative apparatus and method, and illustrative examples shown and described. Accordingly, departures may be made from such details without departing from the scope of the general inventive concept.

What is claimed is:

1. A method of controlling an amount of a product to be dispensed by a chemical dispensing system including a system controller and a peristaltic pump, the peristaltic pump including a first processor operatively coupled to a memory storing pump calibration data, and a motor, the system controller including a second processor in communication with the first processor, the method comprising:

sending, by the second processor to the first processor, a dispense product message indicating the amount of the product to be dispensed by the peristaltic pump;

in response to receiving the dispense product message from the second processor, determining, by the first processor, a motor activation period based on the pump calibration data and the amount of the product to be dispensed; and activating, by the first processor, the motor for the motor activation period to dispense the amount of the product to be dispensed.

2. The method of claim 1 wherein the peristaltic pump further includes a rotor operatively coupled to the motor, and further comprising:

transmitting, by the motor, information indicative of a position of the rotor to the first processor; and determining, by the first processor, the amount of the product dispensed by the pump based on the position of the rotor.

3. The method of claim 1 further comprising:

receiving, by the first processor, temperature data indicative of a temperature of the product being pumped, wherein the first processor determines the amount of the product dispensed by the pump based at least in part on the temperature data.

4. The method of claim 1 wherein the motor activation period comprises an amount of time or a number of rotations for which the motor is activated.

5. The method of claim 1 further comprising:

accumulating, by the first processor, the motor activation period associated with the current length of elastic tubing;

determining, by the first processor, an expected change in a flow rate of the peristaltic pump based at least in part the accumulated motor activation period; and adjusting the motor activation period to compensate for the expected change in the flow rate of the peristaltic pump.

6. The method of claim 5 wherein the system controller includes a user interface and causes the first processor to reset the accumulated motor activation period in response to an input on the user interface indicating that the length of elastic tubing has been replaced.

7. The method of claim 1 wherein the peristaltic pump further includes a length of elastic tubing, and further comprising:

accumulating, by the first processor, the motor activation period associated with the length of elastic tubing; and determining, by the first processor, an expected percentage of life (POL) remaining for the length of elastic tubing based at least in part on the accumulated motor activation period.

8. The method of claim 7 wherein the memory contains data indicative of a type of material of which the length of elastic tubing is composed, and further comprising:

accumulating, by the first processor, an age of the length of elastic tubing, wherein the first processor determines the expected POL remaining for the length of elastic tubing based at least in part on the composition and the age of the current length of elastic tubing.

9. The method of claim 7 further comprising:

comparing, by the first processor, the POL to a predetermined POL threshold; and activating, by the processor, an alarm if the POL is below the predetermined POL threshold.

10. The method of claim 1 further comprising preloading the pump calibration data in the memory of the peristaltic pump.

11. The method of claim 1 wherein the system controller includes a user interface and causes the first processor to update the pump calibration data in the memory in response to new pump calibration data being entered through the user interface.

* * * * *